United States Patent [19]

Blaetz

[11] Patent Number: 4,911,654

[45] Date of Patent: Mar. 27, 1990

[54] DEVICE FOR PREVENTING DISCONNECTION OF OR DAMAGE TO ELECTRICAL CONNECTORS

[76] Inventor: Ewald Blaetz, RD #1, Box 267, Canajoharie, N.Y. 13317

[21] Appl. No.: 273,030

[22] Filed: Nov. 18, 1988

[51] Int. Cl.[4] ..... H01R 13/639

[52] U.S. Cl. ..... 439/372; 439/369

[58] Field of Search ..... 439/277, 354, 359, 362, 439/367, 369, 370, 372, 373, 454, 455, 314

[56] References Cited

U.S. PATENT DOCUMENTS

| | | | |
|---|---|---|---|
| 2,464,893 | 3/1949 | Ross | 439/369 |
| 2,735,993 | 2/1956 | Humphrey | 439/370 X |
| 3,281,755 | 10/1966 | Trager | 439/367 X |
| 3,680,036 | 7/1972 | McCamis et al. | 439/367 X |
| 4,784,612 | 11/1988 | Ryan | 439/369 X |

*Primary Examiner*—Eugene F. Desmond

*Attorney, Agent, or Firm*—Schmeiser, Morelle & Watts

[57] ABSTRACT

An extension cord protection and locking device for securing and enclosing electrical connectors, and control connection and disconnection. A water resistant device is disclosed having a quick release, speed nut type connection. The outer surface of the device is configured with a taper at the ends for unrestricted movement during use.

11 Claims, 2 Drawing Sheets

DEVICE FOR PREVENTING DISCONNECTION OF OR DAMAGE TO ELECTRICAL CONNECTORS

BACKGROUND OF THE INVENTION

The present invention relates to the control of the connection and disconnection of electrical connectors at locations such as building sites, and to devices and structures for accomplishing this purpose. More particularly it relates to a device which encloses and protects electrical connectors at such sites in all weather conditions, but which nevertheless permits rapid and secure connection and disconnection thereof. This device thus keeps the electrical connectors under the control of the users of the temporary electric supply provided through the connectors and their associated flexible lead cords or cables.

It is well known that temporary electrical service is provided at building sites in order to permit various equipment related to the building activity to be used at such sites. Such service is typically provided by a utility company to a single location at a building site. The service provided may comprise a group of hardwired outdoor electrical receptacles fixed to a board and mounted to a pole. Any extension of the service to any and all locations on the site to operate equipment must be made by flexible electrical lead cords. Equipment such as power nailing equipment, power saws, power drills, plumber's power threaders, power mixing equipment and the like are used at such sites. The needs of such equipment for electrical power are not limited to the conventional household levels of amperage and voltage. Higher voltages and/or currents are sometimes needed and the temporary extensions of this power to the equipment in use is needed.

Also often several pieces of equipment are in use at the same time by different craftsmen at different locations on the building site. To accommodate such diverse usage the builder or the individual craftsmen frequently employs an array of cords of different lengths so that an assortment of lengths can be combined to permit any piece of equipment to be used at any location on the site no matter how remote it is from the hardwired electric service receptacles. The ends of each flexible power cord in use is provided with a pair of male and female connectors. Frequently there is no single cord which is long enough to reach a work location at the building site. In such case shorter cords are joined together at their connectors to provide the needed length. In this way cords of any needed length can be assembled. Because of the very diverse use of the flexible extension cords which result the connectors are subject to accidental damage or disconnection.

Moreover it is known that the environmental conditions at building sites are primitive and the electrical connectors can be subjected to dampness or even to rain. Mud and mud puddles are common at such sites and when the connector pairs come in contact with such dampness a danger of shorting of the power carrying electrical contacts of the connectors may occur.

In addition as each craftsman pursues his individual craft at such sites there is considerable opportunity for the artisans to work at cross purposes as, for example, in running heavy equipment over the flexible power cords or over two coupled connectors of such cords. Such heavy equipment, which may be back hoes or dump trucks, can damage the connectors and render them unsafe or unusable. Means which would reduce or prevent such damage would be very valuable in improving the safety and reliability of the temporary supply of electric power to individual craftsmen at such sites.

A number of patents have been issued which are directed toward means for coupling together the connectors of lead cords. These patents are as follows: U.S. Pat. Nos. 4,169,643; 4,643,505; 4,664,463; 3,344,393; 3,059,209; 3,030,601; 3,871,731; 3,721,939; 3,999,829; 4,690,476; 4,440,465; 4,145,105; 4,097,105; 2,037,907; 4,221,449; 3,281,755; 4,183,603; 2,464,893; 4,143,934; and 4,596,430. However none of these patents deal with an essentially crush proof structure which is quickly assembled and disassembled and which protects the contained connectors from moisture and water at construction and similar sites.

BRIEF STATEMENT OF THE INVENTION

Accordingly it is one object of the present invention to provide a protective capsule for caps and connectors as they are used in connection with flexible lead cords or extension cords.

Another object is to provide a means to limit damage to joined connectors from conventional equipment used at building sites, mining sites or other similar sites.

Another object is to provide a connector protector which can be rapidly and easily mounted about a connector pair as well as rapidly and easily removed from such a pair.

Another object is to provide a safety enclosure which can effectively reduce or eliminate the penetration of moisture and water to the live electrical contacts of a joined connector pair.

Other objects and advantages of the invention will be in part apparent and in part pointed out in the description which follows.

In one of its broader aspects object of this invention can be achieved by providing a protective capsule for enclosing a pair of mated electrical connectors. The capsule includes a tubular outer envelope which is internally threaded and which extends beyond the means of the assembled connectors. The capsule also includes externally threaded end plug elements which screw into the envelope to retain the connectors assembled therein against pulls on the flexible cords extending respectively in opposite directions therefrom. The end plugs are slotted longitudinally with slots adapted to receive the flexible cord extending from the respective mated connector. The internal end of each end plug is provided with a yieldable gasketing material which is adapted to be compressed to seal the inner end of the longitudinal slot of the plug and to form an outer seal against the inner surface of the envelope and an inner seal against the outer surface of the insulating jacket disposed about the flexible cord extending from the connector.

Such a yieldable material may be for example an elastomer such as a natural or a synthetic rubber. It may be a closed cell foamed elastomer to permit a high degree of compaction relative to solid elastomer but without danger of moisture or water migrating through the cellular structure once a seal has been formed.

BRIEF DESCRIPTION OF THE DRAWINGS

The invention described in this application may be understood with greater clarity by reference to the accompanying drawings in which:

FIG. 2 is a side elevational view of the plug of FIG. 3 taken along the line 2—2 of FIG. 3 and FIG. 4 is a side elevational view of the plug of FIG. 3 taken along the line 4—4 of FIG. 3.

DETAILED DESCRIPTION OF THE INVENTION

Figure 1:
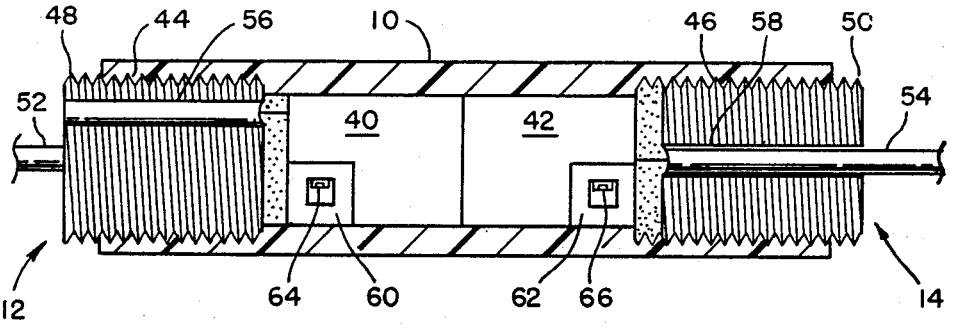
FIG. 1 is an elevational view, in part in section, illustrating a assembled connector pair enclosed within a protective capsule having a tubular outer shell and two end plugs shown cooperating with an enclosed connector pair.

What the present invention makes possible is a simple quick mounting of a protective capsule over and about a pair of connectors. The capsule has three essential parts which operate in cooperation with a connector pair. The first part is a tubular outer member such as tube 10, a sectional view of which is illustrated in FIG. 1. The other two parts are end plugs such as plugs 12 and 14, sectional views of which are illustrated in FIG. 1. The three parts are assembled around and about a connector pair 40 and 42 to cooperate with the connectors and with each other to form the protective capsule. External views of the connector pair 40 and 42 are illustrated in FIG. 1. However there are some very important details of construction and assembly which are not self evident from a view of the Figures and these details are explained in the text which follows.

With respect first to the outer tubular envelope 10, this component can contribute great strength to the overall structure. For example the envelope can be formed of any convenient material including a plastic or even a metal. If a metal is employed as the outer element of the tubular envelope it preferably has a plastic or other insulating inner liner to prevent escape of stray electric currents from the capsule to the exterior where it might come in contact with site personnel. The only other requirements for the material are that it be strong enough to withstand the handling and use to which it is exposed at a construction or mining or similar site, and that the envelope be capable of being formed with the needed internal threads either initially or subsequently through machining the inner wall ends of the envelope.

A preferred material is polycarbonate thermoplastic. This material is transparent and thus permits the viewing of the status and condition of the objects contained within the envelope. Secondly polycarbonate plastic is extremely strong and is the material used in bullet proof windows. It can withstand extremes of handling or mishandling at a construction type of site. For example if the envelope has a length of about seven inches, an internal diameter of about one and three eighths inches and a wall thickness of about one quarter of an inch, it can be struck against or struck by field equipment repeatedly without cracking or breaking. It can also be run over by the tire of a dumptruck without collapsing.

Turning now to the end plugs for use in cooperation with the tubular envelope, these end plugs 12 and 14 are shown in sectional view in their relation to the assembled capsule in FIG. 1. However their appearance is quite different in the unassembled condition. Typical unassembled end plugs are shown in elevational views in FIGS. 2, 3 and 4. In fact the three different views of the FIGS. 2, 3 and 4 are three different views of a single end plug 12.

Figure 2:
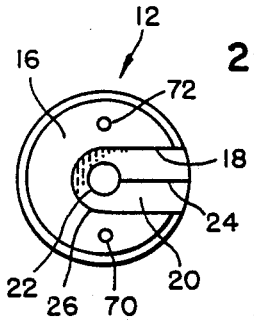
FIG. 2, 3, and 4 are elevational illustrations of the end and side views of slotted end plugs suitable for use in connection with the apparatus of FIG. 1 and which may be assembled with the aid of tools.

FIG. 2 is a view of one end of the plug 12 and illustrates the form of the solid portion 16 of the plug and of the cord receiving longitudinal slot 18 along the side of the plug. This solid portion may also be formed of a plastic such as ABS plastic or a polycarbonate or a nylon plastic. Also visible from the end of the plug is the configuration of a yieldable gasketing material 20 mounted to the far end of the plug 12. This gasketing material has a small center opening 22 which can receive and accommodate a cord while pressing inwardly on the insulated surface covering of the cord. The gasket material also has a slit 24 which provides a yieldable access to permit a cord to be inserted to the bottom 26 of the slot 18 and into the embrace of the center 22 opening of the yieldable gasket 20.

Figure 3:
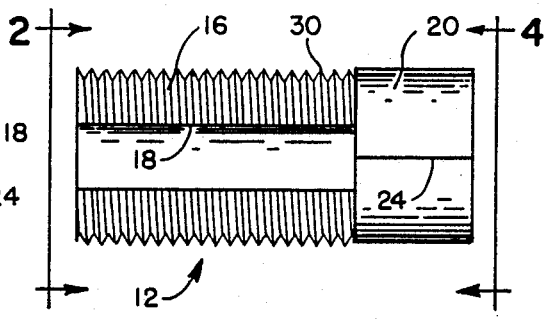
Figure 4:
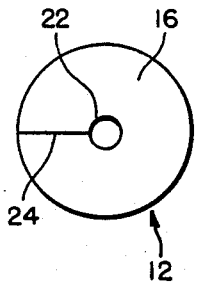

Referring next to FIG. 3 a longitudinal elevational view of the plug 12 of FIG. 2 is provided. In this view it may be seen that there are two portions of the plug. The left hand portion is a body 16 of hard material such as a molded plastic material. As noted above a suitable plastic is ABS plastic or alternatively the plastic may be one of the moldable nylons. A thermoplastic is preferred to provide some small measure of resilience and to avoid the brittleness sometimes associated with thermoset molding plastics. The external threads 30 and the longitudinal slot 18 can be formed integrally with the plug as the plug is molded to maintain low cost of manufacture.

At the right hand end of the plug a yieldable gasketing material 20 is bonded to the threaded portion of the plug 16 to serve as a means for sealing the interior of the capsule against the entry of moisture and/or water. This gasketing material 20 may be a foamed plastic which is of closed cell construction and impervious to the passage of moisture or water therethrough. The gasketing material 20 is shown in FIG. 3 in its expanded condition. However when threaded into the tubular envelope as part of the assembled capsule the gasketing material is compacted and compressed into a much smaller volume as illustrated in FIG. 1. As the plug is threaded into place the gasket 16 presses against all of the surfaces which surround it and forms a seal against such surfaces thus preventing the entry of moisture or water into the protected central portion of the capsule.

With reference next to FIG. 4 this is an elevational view of the plug from the gasket end thereof. As is evident from the figure the gasket 20 has a center opening 22 which is generally smaller than the insulating jacket of a flexible cord to be held therein. This dimensional difference assists in the formation of a seal between the gasket and the plastic coated outer surface of the insulating jacket of a flexible electric cord. The slit 24 permits the entry of a flexible cord into the center opening 22 of the gasket 20. As the gasket 20 is compressed as the plug 10 is screwed into place in the protective capsule the surfaces of the slit 24 are pressed together to provide a seal against the entry of moisture or water. The slit 24 is aligned with the slot 18 proximate gasket 20 so that when a seal is formed as opposite surfaces of the slit are pressed together the end of the slot 18 is also sealed against the entry of moisture or water to the connectors 40 and 42 within the inner portion of the envelope 10.

Lastly the compression of the gasket 20 acts to express the gasket material outwardly against the inner surface of the envelope 10 and, at the same time, inwardly against the insulating jacket of the flexible electric lead cord. The pressing of the gasket 20 against these surfaces results in the formation of a set of seals along the full inner and outer circumferences of the gasket 20 to exclude the entry of moisture or water along these surfaces. The gasket 20 must be sufficiently pliable so that the outward pressure developed as the gasket is compressed cause the internal threads on the envelope to be filled with the gasket material and to be sealed against the entry of moisture or water. In this way the provision of a gasket to press against the envelope and cord jacket at each end of the assembled connectors results in the development of two sets of internal seals within the envelope and the formation of a protective enclosure for the contained connector pair 40 and 42.

The overall result of the cooperation of the parts of the device may be described with respect to FIG. 1. The assembled device includes the outer envelope 10 with two sets of internal threads 44 and 46 formed at a portion of each end of the envelope. Two externally threaded plugs 48 and 50 are positioned in opposite ends of tubular envelope to hold the connector pair 40, 42 in place in the protected interior of the envelope 10. Flexible electrical cords 52 and 54 extend through conforming slots 56 and 58 respectively in plugs 48 and 50, and from the ends of the plugs, to connect to electric supply means, not shown, and to deliver the supplied electricity to use means, also not shown. The cords 52 an 54 may be held to their respective plugs 40 and 42 by means of conventional cord clamps 60 and 62. Such clamps are held in place in the conventional manner by clamp screws 64 and 66 respectively.

Alternative forms of connectors may be employed including the conventional integrally molded connectors. Such connectors are molded directly to the cord ends. The one caution which must be observed in enclosing a wide variety of connectors, which connectors need not be in matching pairs, is that the gasketing material should be sufficiently pliable and sufficiently deep so that a seal is formed within the envelope against both the insulating jacket of the cord and the inner surface of the envelope for whatever combination of connectors are enclosed. As explained above it is these seals which prevent the access of moisture and water to the live electrical contacts within the assembled protective capsule.

Figure 5:
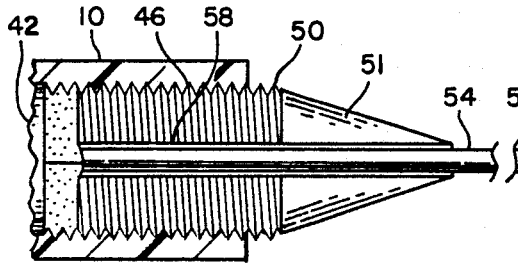
FIGS. 5 and 6 are partial side elevational views of different forms of plugs which are designed for assembly by hand and without the need for tools.

Tools may be employed to assist in threading the plugs into the ends of the envelope. Two small tool access holes 70 and 72 are provided in the outer end of the hard section 16 of the plug as shown in FIG. 2 and 3. The prongs of a bent fork tool may be engaged in these holes to assist in the needed threading. Alternatively an extended plug handle may be formed integrally with the plug to assist in the handling of the plugs and with threading them into the envelope. Such an extended handle plug is illustrated in FIG. 5. FIG. 5 is a partial side elevation, in part in section, of an extended handle plug mounted within one end of an envelope.

Figure 6:
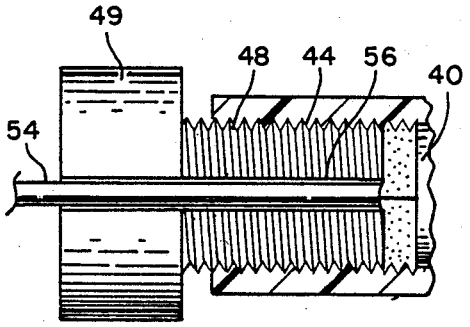

Referring now particularly to FIGS. 5 and 6 two partial views of protective capsules are illustrated. In describing the devices of these figures the same numbering of parts is employed as that employed in FIG. 1 where the parts are the same or substantially the same. Different identification numbers are employed for parts which are different or substantially different.

The principal differences in the devices of FIGS. 5 and 6 as compared to that of FIG. 1 is that the outer ends of the plugs are extended outwardly from the envelope to permit the outwardly extending ends to be gripped and manipulated by hand and thus the need for tools is avoided.

With particular reference to FIG. 5 the plug 50 has an integrally formed handle extension 51. The handle 51 is formed as a molded part of the plug 50 when the plug is originally formed by molding. Thus it has the same strength as the plug itself and can receive substantial force as it is turned by hand to thread it into the envelope and to tighten it in place. Preferably, handle extension 51 is tapered so that when the extension cord is pulled over rough terrain it is less likely to become caught on debris or the like. The taper is form an outer diameter which substantially matches that of the tubular envelope and tapers downward until it is substantially flush with the cord, being no more then ⅛ of an inch from the outer diameter to the cord. In connection with the tightening of the plugs in place it should be understood that the gasket material can serve essentially as a lock washer to urge the plug outward and to develop a locking friction between the thread o the envelope and those of the threaded end of the plug. A similar function can be performed by the formation of the matching threads on the plugs and envelope in the Dardalet form used in artillery piece breech locks. The plug 50 of FIG. 5 with its handle extension 51 can be used interchangeably with the plug 50 of FIG. 1.

Turning now particularly to FIG. 6 the plug 48 is seen to have an enlarged outer handle portion 49. This handle portion 49 has essentially the same function as the handle portion 51 of the plug 50 of FIG. 5. It permits the plug exterior to be handled and gripped so that hand force can be applied to thread the plug 48 into place and to tighten the plug into place. Plug 48 with handle 49 can be used interchangeably with plug 48 of FIG. 1.

Figure 7:
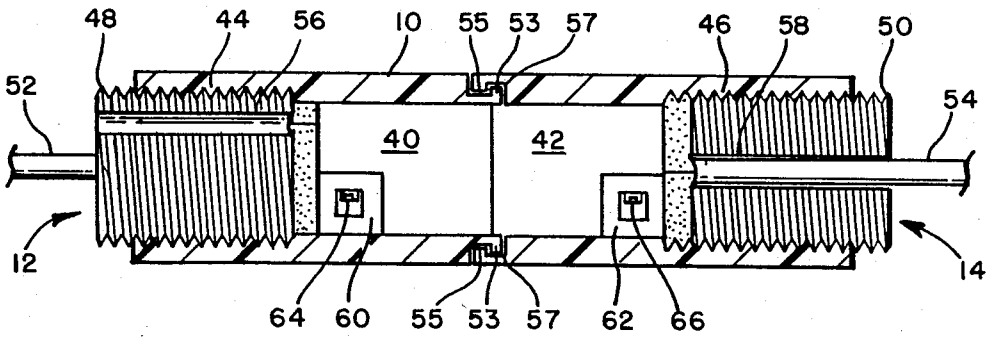
FIG. 7 is an elevational view, in part in section, illustrating an alternate embodiment of the protective capsule.

As shown in FIG. 7 the capsule may be made in two halves joined with a speed nut type mount on half having a key 53 slidable within a channel 55 and rotated into a slot 57 in the opposing half. In this manner, a quick rotation and pulling apart of the halves will disconnect the plugs. If desired, a gasket may be inserted between the halves in order to further assure a watertight seal. Other modifications of the device may be made without departing from the spirit and scope of the invention. In an overall sense therefore there is provided by the present invention a very effective means to protect coupled connectors in the adverse environments which are common to building sites and mining sites and similar sites where temporary extension of electric power must be made to electrical equipment in use at such sites.

What is claimed and sought to be protected by Letters Patent of the U.S. is as follows:

1. A protective capsule for enclosing a pair of mated electrical caps and connectors, said capsule comprising a tubular outer envelope member extending beyond the length of the assembled cap and connector pair, said outer member having an inner diameter slightly greater than that of the cap and connector to be contained therein and being internally threaded at each end thereof, a pair of externally threaded longitudinally slotted end plug members, the slots of said members being dimensioned to receive and nest the flexible cords extending from said cap and connector, the external thread of said end plugs mating with the internal threads of said envelope member to permit the end plugs to be threaded into said envelope to urge said cap and connector securely together and to prevent an unexpected disconnection thereof, and the inner ends of said end plugs having mounted thereto yieldable gasketing material adapted to be compressed by the screw action of said plug in cooperation with the outer ends of said cap and connector to express said gasketing material out against the inner surface of said tubular envelope and inwardly to fill said slot and to form a seal with the external surface of said flexible cord to prevent access of environmental liquids to said cap and connector.

2. The capsule of claim 1 in which the tubular envelope is formed of a transparent plastic.

3. The capsule of claim 1 in which the tubular envelope is formed of a polycarbonate plastic.

4. The capsule of claim 1 in which the tubular envelope has a metal outer shell and an internally threaded plastic inner liner.

5. The capsule of claim 1 in which the yieldable gasketing material is a foam plastic.

6. The capsule of claim 1 in which the yieldable gasketing material foam plastic with a closed cell construction.

7. The capsule of claim 1 in which at least one of the end plugs has an outwardly extending unthreaded handle portion.

8. The capsule of claim 1 in which at least one of the end plugs has an outwardly extending unthreaded handle portion of an outer diameter at least matching that of the tubular envelope.

9. The capsule of claim 1 in which both end plugs have outwardly extending unthreaded handle portions.

10. The capsule of claim 1 in which both plugs have outwardly extending unthreaded handle portions having outer diameters greater than that of the tubular envelope.

11. A protective capsule for enclosing a pair of mated electrical caps and connectors, said capsule comprising:

a two piece tubular outer envelope member secured together with a speed nut type mount extending beyond the length of the assembled cap and connector to be contained therein and being internally threaded at each end thereof, a pair of externally threaded longitudinally slotted end plug members, the slot of said members being dimensioned to receive and nest flexible cords extending from said cap and connector, and the external thread of said end plugs mating with the internal threads of said envelope member to permit the end plugs to be threaded into said envelope to urge said cap and connector securely together and to prevent an unexpected disconnection thereof.

* * * * *